US011391010B2

(12) United States Patent
Coulson

(10) Patent No.: US 11,391,010 B2
(45) Date of Patent: Jul. 19, 2022

(54) EXCAVATOR BUCKET AND MANUFACTURING METHOD

(71) Applicant: SSAB TECHNOLOGY AB, Stockholm (SE)

(72) Inventor: Brian Coulson, Durham (GB)

(73) Assignee: SSAB TECHNOLOGY AB, Stockholm (SE)

( * ) Notice: Subject to any disclaimer, the term of this patent is extended or adjusted under 35 U.S.C. 154(b) by 0 days.

(21) Appl. No.: 16/606,266

(22) PCT Filed: Oct. 2, 2018

(86) PCT No.: PCT/EP2018/076847

§ 371 (c)(1),
(2) Date: Oct. 18, 2019

(87) PCT Pub. No.: WO2019/072652

PCT Pub. Date: Apr. 18, 2019

(65) Prior Publication Data

US 2020/0123733 A1 Apr. 23, 2020

(30) Foreign Application Priority Data

Oct. 12, 2017 (EP) ..... 17196076

(51) Int. Cl.
*E02F 3/40* (2006.01)
*E02F 9/28* (2006.01)

(52) U.S. Cl.
CPC ..... *E02F 3/401* (2013.01); *E02F 9/2883* (2013.01)

(58) Field of Classification Search
CPC ..... E02F 3/40; E02F 3/401; E02F 3/14; E02F 3/654; E02F 3/8157; E02F 9/2883
See application file for complete search history.

(56) References Cited

U.S. PATENT DOCUMENTS 885,049 A * 4/1908 Holcome ..... E02F 3/40 37/444
1,963,847 A * 6/1934 Jersey ..... E02F 3/40 37/446

(Continued)

FOREIGN PATENT DOCUMENTS

CN 1740461 A 3/2006
CN 102425205 A 4/2012

(Continued)

OTHER PUBLICATIONS

International Search Report and Written Opinion dated Nov. 30, 2018 by the International Searching Authority for International Application No. PCT/EP2018/076847, filed on Oct. 2, 2018 and published as WO 2019/072652 on Apr. 18, 2019 (Applicant—SSAB Technology AB) (9 Pages).

*Primary Examiner* — Jessica H Lutz
(74) *Attorney, Agent, or Firm* — Ballard Spahr LLP

(57) ABSTRACT

Bucket for an earth-working or materials-handling machine, which comprises a floor and a side wall, and at least one wear component that is removably attached to the floor and the side wall by means of at least one mechanical fastener. The floor and the side wall are disconnectably connected to each other via the at least one wear component so as to form a replaceable bucket corner edge along at least a part of the floor and the side wall.

12 Claims, 4 Drawing Sheets

(56) References Cited

U.S. PATENT DOCUMENTS

| | | | | | |
|---|---|---|---|---|---|
| 4,890,400 | A * | 1/1990 | Long | E01H 5/06 172/815 |
| 5,564,508 | A * | 10/1996 | Renski | E02F 9/2883 172/772 |
| 2005/0172524 | A1* | 8/2005 | Grant | E02F 3/40 37/446 |
| 2005/0193602 | A1* | 9/2005 | Osgood | E02F 3/40 37/411 |
| 2014/0230293 | A1* | 8/2014 | Lunn | E02F 3/40 37/444 |
| 2017/0314236 | A1* | 11/2017 | Long | E02F 3/40 |

FOREIGN PATENT DOCUMENTS

| | | | |
|---|---|---|---|
| CN | 107075841 | A | 8/2017 |
| JP | S50-127904 | U | 4/1974 |
| JP | S49-037832 | | 10/1975 |
| JP | S54-66503 | A | 5/1979 |
| JP | H1-67752 | | 2/1991 |
| JP | H3-12947 | U | 2/1991 |
| JP | H7-243224 | A | 9/1995 |
| JP | H0988111 | A | 3/1997 |
| JP | 3058178 | U | 3/1999 |
| JP | 2000-129712 | A | 5/2000 |
| JP | 2002-294738 | A | 10/2002 |
| JP | 2002-294739 | A | 10/2002 |
| JP | 2007-24315 | A | 2/2007 |
| JP | 2014-25249 | A | 2/2014 |
| JP | 2017014751 | A | 1/2017 |
| RU | 2110649 | C1 | 5/1998 |
| RU | 2121041 | C1 | 10/1998 |
| RU | 45739 | U1 | 5/2005 |
| RU | 2431020 | C1 | 10/2011 |
| SU | 1760024 | | 9/1992 |
| WO | WO2004/023001 | | 3/2004 |
| WO | WO 2016/061609 | A1 | 4/2016 |
| WO | WO 2016/073280 | A1 | 5/2016 |

* cited by examiner

EXCAVATOR BUCKET AND MANUFACTURING METHOD

CROSS-REFERENCE TO RELATED APPLICATIONS

This application is a U.S. National Phase Application of International Application No. PCT/EP2018/076847, filed Oct. 2, 2018, which claims priority to European Application No. 17196076.8, filed Oct. 12, 2017, each of which are hereby incorporated by reference in their entirety.

TECHNICAL FIELD

The embodiments described herein concern a bucket for an earth-working or materials-handling machine, and a method for manufacturing such a bucket.

BACKGROUND OF THE INVENTION

Earth-working or materials-handling machines, such as excavators, are widely used in the construction and mining industries to move material, such as earth, sand, rocks and snow. In many of these applications, buckets are used to pick up and transport material and for example load it onto a truck or move it to a different location. Such buckets are exposed to a high degree of abrasive wear and it is known to mount wear components (also known as heel segments, heel blocks, cast heels, corners, corner guards, corner shrouds, wear strips or wear plates) on the outer surface of the bucket around the connection between the floor and a side wall of the bucket which forms a bucket corner edge. The wear components provide additional strengthening and abrasion resistance at the bucket corner edges and thereby prolong the working life of the bucket.

When manufacturing such a bucket, an edge of a side wall of the bucket is welded to an edge of the floor of the bucket (usually at an angle of 90°) to form a non-disconnectable bucket corner edge. One or more wear components are then connected to the outer surface of the bucket around the outer surface of the welded edges. The wear components may be welded to the bucket or connected by means of mechanical fasteners, such as screws, bolts or studs.

Wear resistant steel is often used to manufacture a excavator bucket and the welding and heat-intensive cutting operations that are used when manufacturing the bucket may result in the formation of a heat-affected zone (HAZ), which is the area of base material that is not melted and that has had its microstructure and properties altered by the welding or cutting operations. The heat from a welding and/or cutting process and subsequent re-cooling may thereby adversely affect the steel around the weld interface and consequently weaken the bucket in the area of the bucket corner edges.

Furthermore, since buckets for earth-working or materials-handling machines are usually quite large and heavy, moving and supporting bucket parts, such as the floor and the side walls of the bucket, while they are being welded together can make the manufacturing process and repair or maintenance work quite complex and time consuming.

SUMMARY OF THE INVENTION

An object of embodiments described herein is to provide an improved bucket for an earth-working or materials-handling machine, and an improved method of manufacturing such a bucket.

This object is achieved by a bucket that comprises a floor and at least one side wall and at least one wear component that is removably attached to the floor and the side wall by means of at least one mechanical fastener, such as at least one bolt and/or screw and/or a quick-lock-mechanism and/or a quick-release-mechanism. The floor and the side wall of the bucket are disconnectably connected to each other via the at least one wear component so as to form a replaceable bucket corner edge along at least a part of the floor and side wall, i.e. the side wall of the bucket is not connected to the floor of the bucket in any way other than via the at least one component along at least one part of the floor and side wall.

The expression "disconnectably connected" means that the floor and the side wall of the bucket can be disconnected subsequently to being connected to each other simply by removing the at least at one wear component that connects them and without the use of excessive force.

The at least one wear component thereby has a dual function, namely to disconnectably connect the floor and a side wall of the bucket to each other to form a replaceable bucket corner edge, and also to hinder or prevent the removal, damage and/or deformation of material from the bucket when it is in use.

There is namely no weld or glue joint along the at least one part of the floor and side wall that are disconnectably connected via the at least one wear component, which reduces the bucket production time and complexity since the floor and a side wall of the bucket does not have to be connected together in any way before the at least one wear component is attached to the floor and the side wall by means of at least one mechanical fastener.

The at least one wear component forms an integral part of the structure of the bucket and are is not only an element that has been attached to a bucket, i.e. the bucket cannot be used unless the at least one wear element has been attached to the bucket. A gap is namely present between the floor of the bucket and the side wall of the bucket before the at least one wear component is mounted on the bucket. This gap may be up to one millimeter wide, or one or more millimetres or centimetres wide. The at least one wear component is arranged to either to close this gap once it is attached to the floor and the side wall, or to extend over the gap and thereby replace a section of the floor and/or a side wall of the bucket when it is attached to the floor and the side wall. The gap between the floor of the bucket and the side wall of the bucket will reappear if/when one wear component is removed, due to excessive wear or damage, until a new or repaired wear component attached to the floor and the side wall. The presence of such a gap in a region which is often welded and thereby filled with filler material in conventional buckets, reduces the weight of the bucket and the number or amounts of materials required to manufacture the bucket, which may improve the recyclability of the bucket.

Since the at least one wear component is removably attached by means of at least one mechanical fastener, no cutting or welding equipment is necessary on site where the bucket is being used when one or more wear components have to removed due to excessive wear or damage occurring during the use of the bucket. The one or more wear components, and consequently the replaceable bucket corner edge formed by its/their connection to the floor and a side wall of the bucket, may be quickly and simply removed and replaced on site without the use of excessive force and without having to detach the bucket from the excavator or transport it to a workshop, which facilitates repair and maintenance work and minimizes downtime. It should however be noted that if part of a wear component and/or mechanical fastener become(s) damaged during the use of the bucket, for example if the thread of a mechanical fastener becomes damaged during the use of the bucket, it may be necessary to remove the wear component and/or mechanical fastener using removal-aiding apparatus such as a cutting tool or an oxyacetylene torch.

The at least one wear component is attached along at least one half, or one third, or one quarter, or one fifth of the total length of the edge of the floor of the bucket, or along any distance up to and including the entire length of the edge of the floor of the bucket, depending on the application(s) in which the bucket is used. The at least one wear component is preferably located along the part of the bucket that experiences the greatest wear during use, such as for example, over the central third of the edge of the floor of the bucket measured from where the floor of the bucket terminates at the front cutting edge of the bucket to where the floor of the bucket terminates at the top assembly of the bucket. The working life of the bucket may thereby be prolonged since the designated at least one replaceable wear component will be subjected to wear rather than the material(s) constituting the floor and/or a side wall of the bucket.

It should be noted that the expression "side wall" as used herein is not necessarily intended to mean a wall forming a side of a bucket, but it can mean any wall/panel that is arranged at any angle to the floor of a bucket. A bucket according to embodiments described herein may have any number of such side walls.

According to an embodiment of the bucket, a gap is present between the edge of the floor and the edge of the side wall before at least one wear component is attached to the bucket and the at least one wear component is arranged to close or traverse the gap. The gap may have a maximum length of 5 mm, 10 mm, 15 mm, 20 mm, 25 mm, 30 mm, 35 mm, 40 mm, 45 mm, 50 mm, 55 mm, 60 mm, 65 mm, 70 mm, 75 mm, 80 mm, 85 mm, 90 mm, 95 mm, 100 mm or more.

According to an embodiment of the bucket, the at least one wear component has an inside surface when mounted on the bucket, and the inside surface is curved, whereby the floor and the side wall will not be connected at an angle of 90° but will have a rounded/curved surface therebetween. There will namely be no vertex from which an angle can be measured in the region where the floor and side wall of the bucket are connected. Such a lack of a 90° corner inside the bucket may facilitate the loading and unloading of the bucket since it may prevent material or objects from getting stuck in the inside corners of the bucket.

According to an embodiment of the bucket, the at least one wear component is arranged to be entirely located outwards of an inner surface of the floor and an inner surface of the side wall when mounted on the bucket, i.e. when viewed radially in a direction from the centre of the bucket, i.e. the centre of the inside volume of the bucket that is filled with material when the bucket is in use, to the outside of the bucket, the floor and side wall of the bucket are located closer to the centre of the bucket than the at least one wear component.

Alternatively, the inside surface of the at least one wear component may be arranged to lie flush with an inside surface of the floor of the bucket and an inside surface of the side wall of the bucket when the at least one wear component is mounted on the bucket, i.e. the inside surfaces of the floor, the at least one wear component, and the side wall all lie in the same plane and thereby form a continuous inside surface, i.e. the at least one wear component ensures that there is a smooth and continuous surface between the floor of the bucket and a side wall of the bucket, which may also facilitate the loading and unloading of the bucket.

A curved and/or continuous inside surface in an inside corner of the bucket may result in improved flow characteristics of material across the inner surface of the bucket when loading and unloading the bucket leading to less material becoming trapped in the inside corners of the bucket and/or less "hang up" of material in the bucket as compared to a bucket having a side wall welded at angle of 90° to the floor of the bucket.

According to an embodiment of the bucket, the at least one wear component has an outer surface when mounted on the bucket, and the outer surface is curved. The entire wear component or at least the outer surface of at least one wear component may comprise wear and abrasion-resistant steel, hardened steel or case-hardened steel. The steel may have a Brinell hardness of at least 500, preferably a Brinell hardness of 525-575 or more. According to an embodiment of the bucket, the at least one wear component comprises Hardox®.

According to an embodiment of the bucket, the at least one wear component comprises a plurality of individually removable wear components. The plurality of wear components may be adjacently abutting when mounted on the bucket. The wear components may thereby form a continuous arrangement when mounted on the bucket whereby there are no gaps between adjacent wear components.

Alternatively, the at least one wear component comprises a plurality of non-adjacently abutting wear components when mounted on the bucket. A gap may namely be present between two or more adjacent wear components to allow for flexion of the wear components when the bucket is in use, whereby a non-continuous arrangement is formed by the wear components. This may reduce or eliminate cracking or loosening of the wear components when the bucket is in use. A space of up to a maximum length of 1 mm, 2 mm, 3 mm, 4 mm, 5 mm, 6 mm, 7 mm, 8 mm, 9 mm, 10 mm or more may be left between adjacent wear components or between at least two adjacent wear components.

It should be noted that the at least one wear component may comprise a plurality of wear components some of which are adjacently abutting and some of which are not. Said plurality of wear components may be mounted so that they are parallel to one other, or in any other suitable manner.

A wear component may be mounted transversely or in parallel or diagonally with respect to the direction of flow of material into the bucket when the bucket is in use.

According to an embodiment of the bucket, at least one of the plurality of wear components is arranged to be connected to at least one adjacent wear component when the plurality of wear components is mounted on the bucket.

According to an embodiment of the bucket, the plurality of wear components comprises at least one wear component having a different thickness and/or comprising a different material than other wear components of the plurality of wear components. Alternatively, all of the wear components of a plurality of wear components may be identical and/or have the same thickness and/or shape and/or comprise the same material and/or have the same shape, which may facilitate their manufacture and mounting, as well as repair and maintenance work. Furthermore, if all of the wear components are identical, storage will be facilitated since there is no need to store a plurality of different wear components. A wear component may have a uniform or non-uniform thickness. For example, a wear component may have a maximum thickness at the middle of the wear component.

According to an embodiment of the bucket, the at least one wear component is a cast component. Alternatively, the at least one wear component is a fabricated component. A plurality of wear component may comprise both cast and fabricated wear components, which increases the design options for a bucket manufacturer.

According to an embodiment of the bucket, both the floor and the side wall each comprise at least one hole that is arranged to receive and accommodate the mechanical fasteners.

Each hole may be arranged to receive and accommodate one mechanical fastener that is arranged to connect a plurality of wear components to the bucket so that the number of holes that needs to be made in the floor and the side wall(s) of the bucket may be kept to a minimum. According to an embodiment of the bucket, the floor and/or the side wall of the bucket comprise at least one countersunk passage to receive and accommodate the mechanical fasteners. According to an embodiment the at least one hole is threaded and is arranged to accommodate a threaded mechanical fastener.

According to an embodiment of the bucket, the at least one wear component is arranged to be moveable with respect to the floor and the side wall when it has been removably attached to the floor and the side wall by means of at least one mechanical fastener, i.e. there is play between the wear component and the floor and side wall of the bucket when it has been attached to the floor and side wall of the bucket by means of at least one mechanical fastener. The mechanical fasteners are tightened with respect to the floor and side wall but allow the wear component to move freely on the bucket side lower, which will prevent or hinder the mechanical fasteners from becoming loose during the use of the bucket due to working pressure acting on the at least one wear component.

The object of embodiments described herein is also achieved by a kit of parts for use with a bucket according to any of the embodiments described herein. The kit comprises at least one wear component, at least one mechanical fastener and optionally at least one spacer.

The object of embodiments described herein is also achieved by a method for manufacturing a bucket for an earth-working or materials-handling machine according to any of the embodiments described herein, whereby the bucket comprises a floor and a side wall and at least one wear component that is removably attached to the floor and the side wall by means of at least one mechanical fastener. The method comprises the step of disconnectably connecting the floor and the side wall to each other via the at least one wear component so as to form a replaceable bucket corner edge along at least a part of the floor and the side wall.

According to an embodiment of the method, it comprises the step of connecting the floor to the side wall in at least one region outside the at least one part of the floor and side wall to which the at least one component is attached by welding.

According to an embodiment of the method, it comprises the step of manufacturing the at least one wear component from steel and cutting the steel when it is immersed in a cooling medium, such as water or any other liquid cooling medium. This ensures that the wear component 18 is manufactured in a way that minimizes or eliminates heat-intensive cutting operations which may result in the formation of a heat-affected zone (HAZ). Additionally, since the at least one wear component will not be welded when it is attached to the bucket, but attached by means of at least one mechanical fastener, its physical properties will not be adversely affected when it is mounted on the bucket.

Furthermore, since the floor of the bucket is not welded to the side wall of the bucket along the at least one part of the floor and side wall to which the at least one component is attached, no heat-affected zone (HAZ), which can adversely affect the physical properties of the material(s) from which the floor and/or side wall are made, will be formed along or around the replaceable bucket corner edge. The bucket according to the embodiments described herein will not therefore be weakened in the area in which its floor is connected to a side wall and the wear component will retain the physical properties it has in its manufactured state.

According to an embodiment of the method, it comprises the step of removably attaching the at least one wear component to the floor and the side wall of the bucket by means of at least one mechanical fastener so that the at least one wear component is moveable with respect to the floor and the side wall when it has been removably attached to the floor and the side wall of the bucket.

BRIEF DESCRIPTION OF THE DRAWINGS

The embodiments described herein will hereinafter be further explained by means of non-limiting examples with reference to the appended figures where.

It should be noted that the drawings have not necessarily been drawn to scale and that the dimensions of certain features may have been exaggerated for the sake of clarity.

DETAILED DESCRIPTION OF EMBODIMENTS

Figure 1:
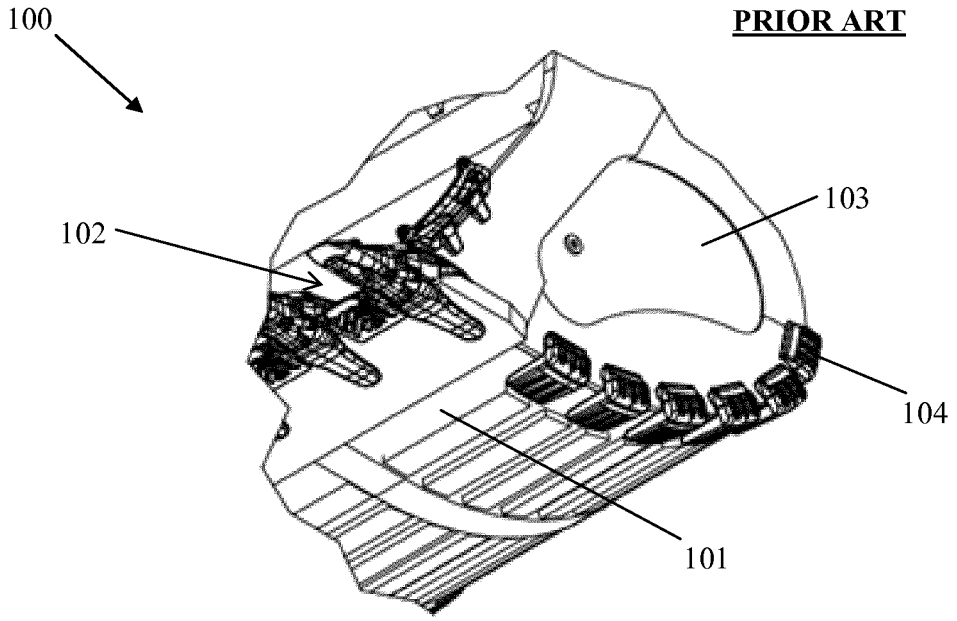
FIG. 1 shows a bucket according to the prior art.

FIG. 1 shows a perspective view of a steel bucket 100 according to the prior art viewed at angle from below. The prior art bucket 100 has a floor 101 that extends from a front cutting edge 102 of the bucket 100 up to a top assembly (not shown) that connects the prior art bucket 100 to an earth-moving or materials-handling machine. The prior art bucket 100 also comprises a side wall 103, an edge of which is welded to an edge of the floor 101 of the prior art bucket 100 along the entire length of the floor 101 of the bucket to form a non-disconnectable and non-replaceable bucket corner edge. The prior art bucket 100 also comprises a plurality of spaced apart wear components that have been welded to outside of the prior art bucket 100 across the weld joint connecting the floor 101 of the prior art bucket to its side wall 103.

In order to remove and replace one of the wear components 104 of the prior art bucket 100, the wear component 104 must be cut off the prior art bucket 101 and a new wear element 104 must be welded in its place. Such an operation will require cutting and welding equipment being brought to the site where the bucket 100 is being used, or the prior art bucket 100 being moved to a workshop.

Furthermore, since the edges of the floor 101 and the side wall 103 of the prior art bucket 100 have been welded together, and since the wear components 104 have been welded to the bucket in the vicinity of the weld joint connecting the floor 101 and the side wall 103 of the bucket 100, the microstructure and physical properties of the material constituting the prior art bucket 100 may be adversely affected during the manufacture and/or during repair/maintenance work. This may adversely affect the bucket 100 in a region that requires high strength and good abrasion resistance when the bucket is in use.

Figure 2:
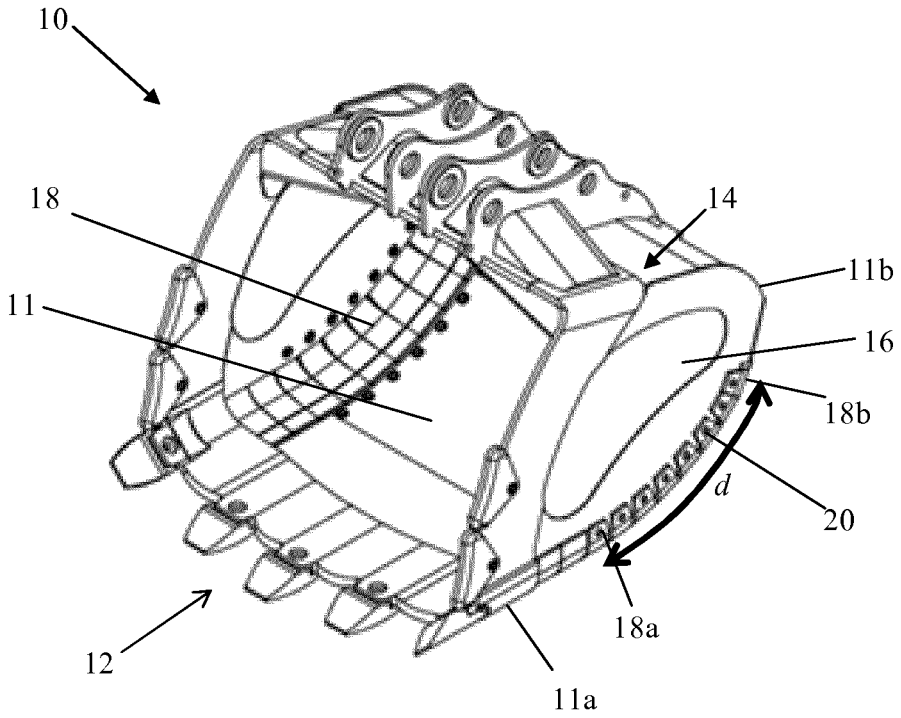
FIG. 2 show a bucket according to an embodiment described herein.

FIG. 2 shows a perspective view of a bucket 10, such as a backhoe excavator bucket, according to an embodiment described herein viewed at an angle from above. The bucket 10 comprises a floor 11*a* that extends from a front cutting edge 12 to a top assembly 14 that connects the bucket 10 to an earth-moving or materials-handling machine, such as a hydraulic excavator (not shown).

The illustrated bucket 10 comprises two opposed side walls 16 and a plurality of wear components 18, such as 5 to 20, or 8 to 10, or 10 to 15 or 15 to 20 wear components, that extend along a distance, d, along an edge of the floor 11 and an edge of the side wall 16 on both sides of the bucket 10.

The, or each wear component 18 according to any of the embodiments described herein is removably attached to the floor 11 and a side wall 16 by means of one or more mechanical fasteners 20, such as bolts. It should be noted that the or each wear component 18 according to any of the embodiments described herein may be removably attached to the floor 11 and a side wall 16 using just one mechanical fastener 20, or using a plurality of mechanical fasteners 20. Alternatively, a plurality of wear components 18 may be removably attached to the floor 11 and a side wall 16 using just one mechanical fastener 20. The expression "by means of at least one mechanical fastener" as used in this document is thereby intended to mean an average of exactly one, less than one, or more than one mechanical fastener 20 per wear component 18.

An edge of the floor 11 is connected to an edge of each side wall 16 which is located adjacently to the edge of the floor 11 solely via the wear components 18 along the distance, d. The floor 11 may however be connected to the side walls 16 in any suitable way, such as by welding or by means of at least one mechanical fastener, in one or more regions outside the distance, d, such as in region 11*a* between the front cutting edge 12 of the bucket and the first wear component 18*a* and/or in region 11*b* between the last wear component 18*b* and the top assembly 14. One part of the bucket corner edge which is formed by disconnectably connecting the floor 11 to a side wall 16 of the bucket (namely the part between regions 11*a* and 11*b* in FIG. 2 which extends a distance, d, along the bucket corner edge) does not comprise a weld joint, but the floor 11 and the side wall 16 are connected to each other solely via the wear components 18.

Before the wear components 18 are mounted on the bucket 10, a gap is present between the edge of the floor 11 and the edge of each side wall 16 at the location that is to be occupied by the wear elements 18, i.e. along distance, d. Once the wear components 18 have been mounted on the bucket 10 they will either close or traverse this gap. The floor 11 of the bucket 10 is not connected to the side wall 16 in any way along distance d until the wear components 18 have been mounted on the bucket 10, i.e. the bucket 10 cannot be used until the at least one wear element 18 has been mounted on the bucket 10.

According to an embodiment of the bucket 10, it may comprise a single wear element 18 that is arranged to extend along the entire distance, d.

A bucket 10 according to embodiments described herein is suitable for use with any earth-moving or materials-handling machine, such as a compact excavator, a dragline excavator, amphibious excavator, power shovel, steam shovel, suction excavator, walking excavator, bucket wheel excavator, a bulldozer, a loader, mining equipment, a tractor, a skid steer loader etc. The earth-moving or materials-handling machine may be a ground-engaging machine, or may have a bucket that is arranged to engage some other surface, such as a pit wall in open pit mining.

The earth-moving or materials-handling machine may for example be used for digging a trench, hole or foundations, in forestry work, construction, landscaping, mining, river dredging or snow removal.

Figure 3:
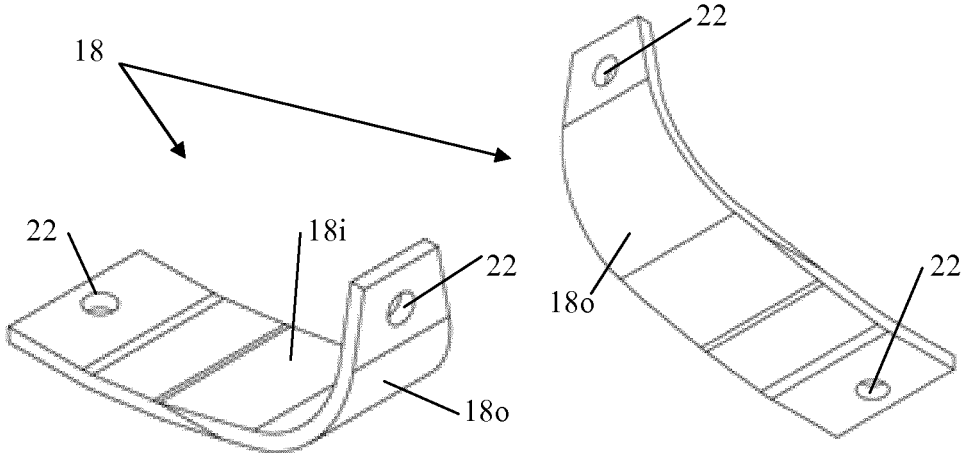
FIG. 3 shows a wear component of a bucket according to an embodiment described herein.

FIG. 3 shows a wear component 18 from two different angles. The wear component 18 has an inside surface 18*i* which may form part of the inside surface of a bucket 10 when it is mounted on the bucket 10 or the entire wear component 18 may be arranged to be entirely located outwards of an inner surface of the floor 11 of the bucket 10 and outwards of an inner surface of the side wall 16 of the bucket 10 when it is mounted on the bucket 10, whereby it extends around the outer surface of the floor 11 and the side wall 11 of the bucket 10.

The inside surface 18*i* of the wear component 18 may be curved. The inside surface 18*i* of the wear component 18 may be arranged to lie flush with an inside surface of the floor 11 of the bucket and an inside surface of a side wall 16 of the bucket 10 when it is mounted on the bucket 10. Less material is thereby required to manufacture the floor 11 and/or side wall 16 of a bucket 10 of a certain size because the at least one wear component 18 will replace a section of the floor 11 and/or side wall 16 of the bucket 10 in the region where the floor 11 is usually connected to a side wall 16 of the bucket. The wear component 18 also has an outer surface 18*o* that is curved. The wear component 18 may be a cast or fabricated component.

In the illustrated embodiment, the wear component 18 has a hole 22 at each end which is arranged to receive and accommodate a mechanical fastener, such as a bolt. The mechanical fastener removably connects the wear component 18 to the floor 11 of a bucket 10 and to a side wall 16 of the bucket 10. Such wear components 18 can be simply and quickly removed and replaced on site when they are excessively worn or damaged, without having to move the bucket 10 to a workshop, which results in a minimum of downtime. One or more wear components 18 may namely be detached from the bucket 10 by removing the at least one mechanical fastener 20 by which it/they is/are attached to the floor 11 and side wall 16 of the bucket 10 and subsequently attaching one or more new wear components 18 to the bucket 10 by means of at least one mechanical fastener 20. A wear component 18, floor 11 or side wall 16 of a bucket 10 may have any number or arrangement of holes for receiving and accommodating mechanical fasteners.

It should be noted that the wear components 18 described herein may be of any suitable shape and/or size and may have any suitable profile. A wear component 18 may for example have a curved inner and/or outer surface when it is mounted on the bucket 10. A wear component 18 may comprise a flat surface on at least part of its inner and/or outer surface when it is mounted on the bucket 10.

Figure 4:
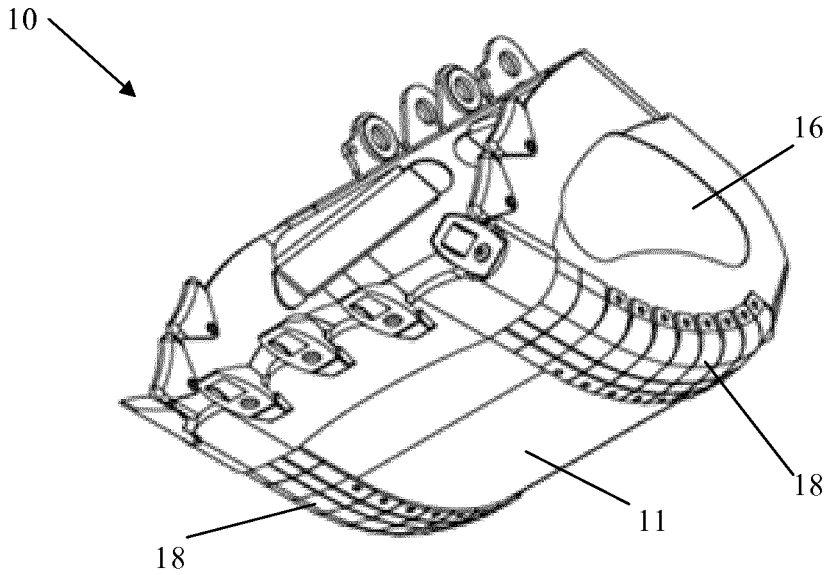
FIGS. 4 & 5 show the bucket illustrated in FIG. 2 from different angles.

FIG. 4 shows a perspective view of a bucket 10 according to an embodiment described herein viewed at an angle from below. The bucket 10 comprises a plurality of individually removable and adjacently abutting wear components 18, whereby two or more of the wear components 18 are in contact with each along an edge thereof. Alternatively, a bucket 10 may comprise a plurality of individually removable and non-adjacently abutting wear components 18, whereby there is a space between any two or more adjacent wear components 18 or between each wear component 18.

According to an embodiment, each of a plurality of wear components 18 may be arranged to be connected to at least one adjacent wear component 18 when the plurality of wear components 18 is mounted on the bucket 10. For example, two or more wear components 18 may comprise a male element on one side, and a female element on the other side so that they can fit together like jigsaw pieces. Alternatively, a plurality of wear components 18 may be placed side by side along distance, d.

A plurality wear components 18 may comprise at least one wear component 18 having a different thickness and/or comprising a different material than other wear components 18 of said plurality of wear components 18. One or more wear components 18 having a greater thickness and/or made from a more wear and abrasion resistant steel than other wear components 18 of said plurality of wear components 18 may for example be mounted on the part(s) of a bucket 10 that is/are subjected to the greatest wear and damage during use.

Figure 5:
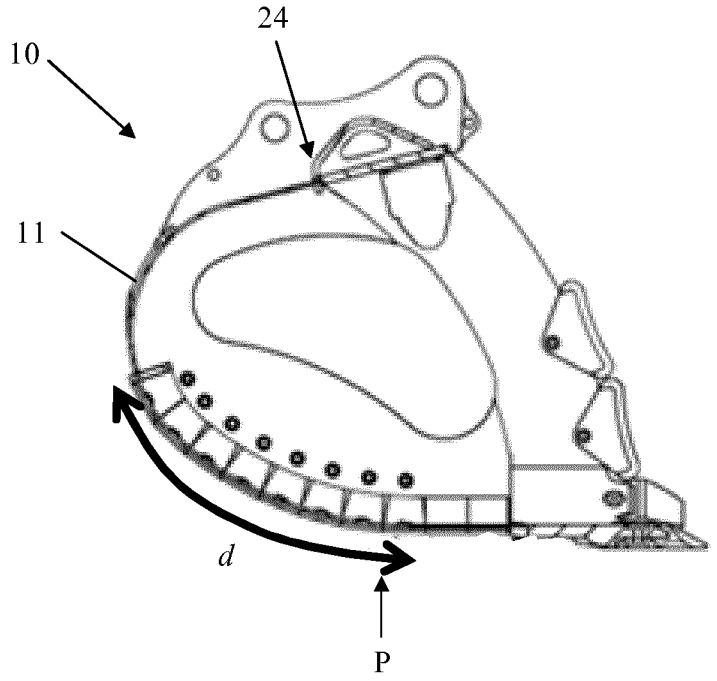

FIG. 5 shows a bucket 10 from the side. The part(s) of the illustrated bucket 10 that is/are subjected to the greatest wear and damage during use may for example be located along the outside edges at the sides of the bucket 10 upwards of the point P at which point the floor 11 of the bucket 10 starts to lift off the ground when the bucket 10 is lying on the ground.

Figure 6:
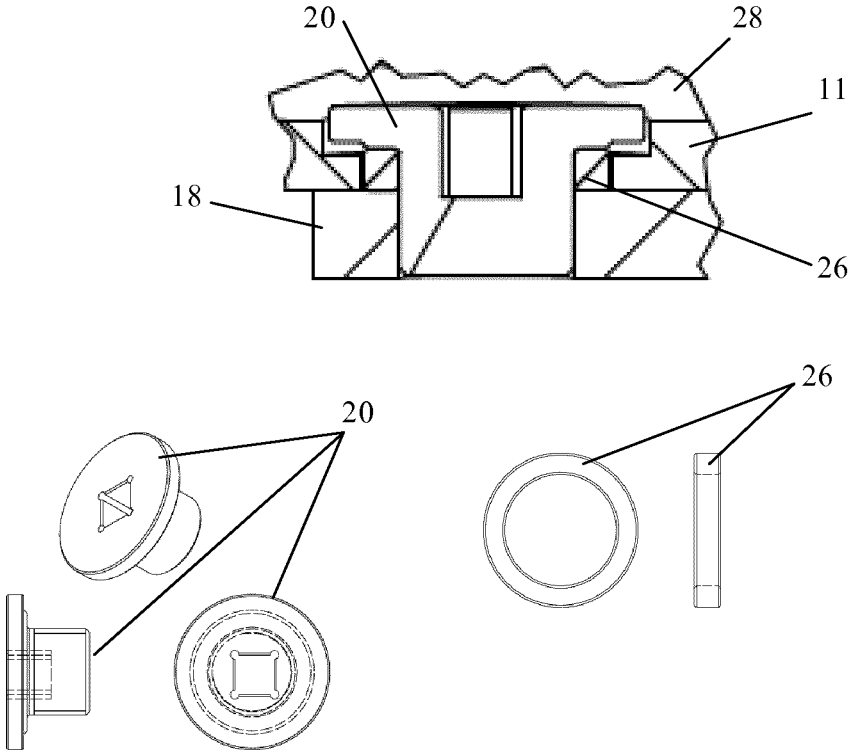
FIG. 6 shows a kit according to an embodiment described herein.

FIG. 6 shows a kit for use with a bucket 10 according to any of the embodiment described herein. The kit comprises at least one wear component 18, at least one mechanical fastener 20 and optionally, at least one spacer 26 if necessary. The wear component 18 is arranged to be removably attached to the floor 11 and a side wall 16 of a bucket 10 by means of at least one mechanical fastener 20.

According to an embodiment, a mechanical fastener 20 and a spacer 26 are arranged to be tightened with respect to the floor 11 and the side wall of the bucket 16 to removably attach one wear component 18 or a part thereof, or a plurality of wear components 18 to a bucket 10 but to allow the wear component(s) 18 to move freely with respect to the floor 11 and the side wall 16 when the wear component 18 has been attached to the floor 11 and the side wall 16 of the bucket 10. This will prevent or hinder the mechanical fastener(s) 20 from becoming loose during the use of the bucket 10 due to working pressure acting on the wear components 18. For example, the at least one mechanical fastener 20 may be threaded and the wear component 18 may comprise at least one threaded hole to accommodate the at least one threaded mechanical fastener 20. No tool is needed since the mechanical fastener 20 bolts directly into the wear component 18 and the wear component 18 acts as a nut.

The at least one mechanical fastener 20 and/or at least one spacer 26 are dimensioned and/or designed in order to allow the at least one wear component 18 to move freely with respect to the floor 11 and the side wall 16 of the bucket once the at least one wear component 18 has been removably attached to the floor 11 and the side wall 16 of the bucket 10.

According to an embodiment the head of a mechanical fastener 20 is arranged to lie flush with the floor 11 on the inside 28 of the bucket 10.

Figure 7:
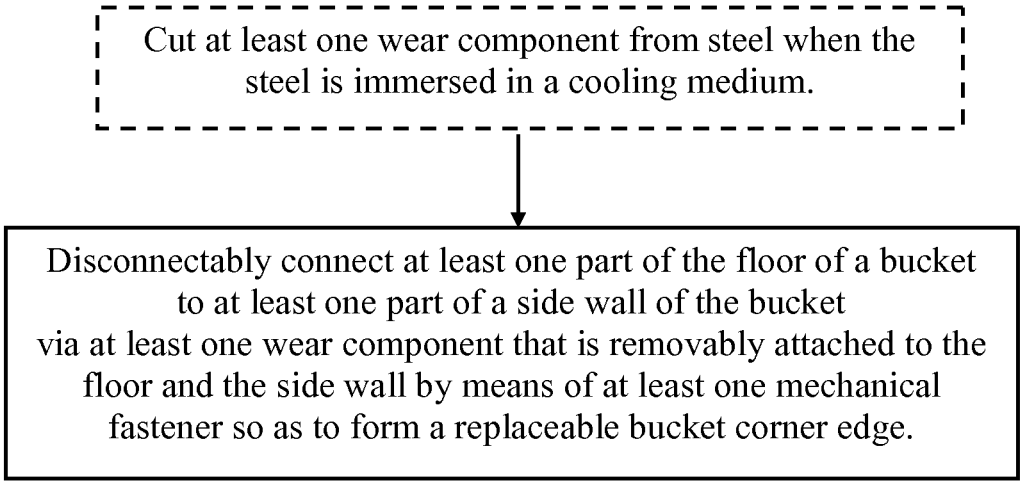
FIG. 7 is a flow chart showing the steps of a method according to an embodiment described herein.

FIG. 7 is a flow chart showing the steps of an embodiment of the method for manufacturing a bucket 10 for an earth-working or materials-handling machine, whereby the bucket 10 comprises a floor 11 and a side wall 16 and at least one wear component 18 that extends along at least a part of said bucket corner edge. The at least one wear component 18 is removably attached to the floor 11 and the side wall 16 by means of at least one mechanical fastener 20. The method comprises the step of disconnectably connecting the floor 11 of the bucket 10 to the side wall 16 of the bucket via the at least one wear component 18 along at least a part of the floor 11 and the side wall 16. One, some or all of the wear components 18 that are attached to a bucket 10 may be moveably attached to the floor 11 and the side wall 16 by means of at least one mechanical fastener 20. Alternatively or additionally, one, some or all of the wear components 18 that are attached to a bucket 10 may be non-moveably attached to the floor 11 and the side wall 16 by means of at least one mechanical fastener 20.

Before and/or after the floor 11 and the side wall 16 of the bucket have been disconnectably connected along at least a part of the floor 11 and the side wall 16, the floor 11 of the bucket 10 may be connected to the side wall 16 of the bucket 16 in at least one region outside said at least one part of said floor 11 and said side wall 16, such as by welding, which will provide a non-disconnectable connection in that at least one region outside said least one part of said floor 11 and said side wall 16. Alternatively, the floor 11 of the bucket 10 may be mechanically attached to the side wall 16 in regions 11*a* and 11*b* (shown in FIG. 2), which will provide a disconnectable connection in regions 11*a* and 11*b*. Furthermore, the top assembly 24 of the bucket 10 (shown in FIG. 5) may be welded or mechanically attached to the floor 11.

Since no welding will take place along at least a part of said floor 11 and said side wall 16 when manufacturing or repairing the bucket, no heat-affected zone (HAZ) will be formed along said at least one part of said floor 11 and said side wall 16, and so the microstructure and properties of the material constituting the floor 11, the side wall 16 and the wear elements will not be altered or adversely affected along at least one part of said floor 11 and said side wall 16, which results in a stronger bucket structure along said at least one part of said floor 11 and said side wall 16.

According to an embodiment, the method may comprise the step of manufacturing at least one wear component 18 from steel and cutting the steel 18 when it is immersed in a cooling medium so that the microstructure and properties of the at least one wear component 18 are not adversely affected by it being subjected to a heat intensive cutting operation and subsequent re-cooling.

Further modifications of the embodiments described herein within the scope of the claims would be apparent to a skilled person.

The invention claimed is:

1. A bucket for an earth-working or materials-handling machine, whereby said bucket comprises a floor and a side wall, and at least one wear component that is removably attached to said floor and said side wall by at least one mechanical fastener, characterized in that said floor and said side wall are disconnectably connected to each other via said at least one mechanical fastener that provides for said floor and said wall being removably attached to said at least one wear component so as to form a replaceable bucket corner edge along at least a part of said floor and said side wall, whereby a gap is present between said edge of said floor and said edge of said side wall and said at least one wear component is arranged to traverse said gap, whereby said at least one wear component has an inside surface which forms part of an inside surface of said bucket when said at least one wear component is mounted on said bucket.

2. The bucket according to claim 1, characterized in that said at least one wear component has an inside surface when mounted on said bucket, and said inside surface is curved.

3. The bucket according to claim 1, characterized in that said at least one wear component is arranged to be entirely located outwards of an inner surface of said floor and an inner surface of said side wall when mounted on said bucket.

4. The bucket according to claim 1, characterized in that an inside surface of said at least one wear component that is arranged to lie flush with an inside surface of said floor and an inside surface of said side wall when mounted on said bucket.

5. The bucket according to claim 1, characterized in that said at least one wear component has an outer surface when mounted on said bucket, and said outer surface is curved.

6. The bucket according to claim 1, characterized in that said at least one wear component comprises a plurality of adjacently abutting wear components when mounted on said bucket.

7. The bucket according to claim 1, characterized in that said at least one wear component comprises a plurality of non-adjacently abutting wear components when mounted on said bucket.

8. The bucket according to claim 6, characterized in that said plurality of wear components comprises at least one wear component having a different thickness or comprising a different material than other wear components of said plurality of wear components.

9. The bucket according to claim 1, characterized in that said at least one wear component is arranged to be moveable with respect to said floor and said side wall when it has been removably attached to said floor and said side wall by said at least one mechanical fastener.

10. A method for manufacturing the bucket for an earth-working or materials-handling machine of claim 1, characterized in that said method comprises the steps of disconnectably connecting said floor and said side wall to each other via said at least one mechanical fastener that provides for said floor and said wall being removably attached to said at least one wear component so as to form said replaceable bucket corner edge along said at least a part of said floor and said side wall.

11. The method according to claim 10, characterized in that the method comprises the step of manufacturing said at least one wear component from steel, and cutting said steel when it is immersed in a cooling medium.

12. The method according to claim 10, characterized in that the method comprises the step of removably attaching said at least one wear component to said floor and said side wall by said at least one mechanical fastener so that said at least one wear component is moveable with respect to said floor and said side wall when it has been removably attached to said floor and said side wall of said bucket.

* * * * *